US011517093B2

(12) United States Patent
Yamasaki

(10) Patent No.: US 11,517,093 B2
(45) Date of Patent: Dec. 6, 2022

(54) DRAWING DEVICE AND DRAWING METHOD

(71) Applicant: CASIO COMPUTER CO., LTD., Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 260 days.

(21) Appl. No.: 16/770,108

(22) PCT Filed: Oct. 26, 2018

(86) PCT No.: PCT/JP2018/039802
§ 371 (c)(1),
(2) Date: Jun. 5, 2020

(87) PCT Pub. No.: WO2019/111578
PCT Pub. Date: Jun. 13, 2019

(65) Prior Publication Data

US 2020/0383452 A1 Dec. 10, 2020

(30) Foreign Application Priority Data

Dec. 8, 2017 (JP) ..... JP2017-235643

(51) Int. Cl.
*A45D 29/00* (2006.01)
*B41J 2/205* (2006.01)

(52) U.S. Cl.
CPC ..... *A45D 29/00* (2013.01); *B41J 2/2054* (2013.01); *A45D 2029/005* (2013.01)

(58) Field of Classification Search
None
See application file for complete search history.

(56) References Cited

U.S. PATENT DOCUMENTS 6,286,517 B1 9/2001 Weber et al.
6,755,510 B2 6/2004 Murakami et al.
(Continued)

FOREIGN PATENT DOCUMENTS

CN 102756557 A 10/2012
JP H09118025 A 5/1997
(Continued)

OTHER PUBLICATIONS

Korean Office Action (and English language translation thereof) dated May 27, 2021 issued in Korean Application No. 10-2020-7013908.
(Continued)

*Primary Examiner* — Erica S Lin
(74) *Attorney, Agent, or Firm* — Holtz, Holtz & Volek PC

(57) ABSTRACT

A drawing device includes a drawing head and a processor which controls the drawing head. The drawing head draws an image by forming at least one of a first droplet dot formed by a first droplet and a second droplet dot formed by a second droplet including a larger droplet amount than the first droplet on a drawing target surface curved convexly along a first direction. The processor controls the drawing head to form the second droplet dot in at least a part of an adjustment region in at least one end of ends in the first direction on the drawing target surface based on drawing data of the image, and the drawing data is image data for drawing the image on a non-curved surface.

15 Claims, 7 Drawing Sheets

(56) References Cited

U.S. PATENT DOCUMENTS

| | | | | |
|---|---|---|---|---|
| 8,814,289 | B2 | 8/2014 | Yamasaki | |
| 2009/0128600 | A1* | 5/2009 | Nagata | B41J 2/145 347/40 |
| 2012/0274683 | A1* | 11/2012 | Yamasaki | B41J 29/02 347/2 |

FOREIGN PATENT DOCUMENTS

| | | | |
|---|---|---|---|
| JP | 2003311966 | A | 11/2003 |
| JP | 2007301728 | A | 11/2007 |
| JP | 2015047473 | A | 3/2015 |
| JP | 2015047582 | A | 3/2015 |
| JP | 2015150771 | A | 8/2015 |
| JP | 2016019926 | A | 2/2016 |
| WO | 0191598 | A1 | 12/2001 |

OTHER PUBLICATIONS

International Search Report (ISR) (and English translation thereof) dated Jan. 29, 2019 issued in International Application No. PCT/JP2018/039802.

Written Opinion dated Jan. 29, 2019 issued in International Application No. PCT/JP2018/039802.

International Preliminary Report on Patentability (IPRP) (and English language translation thereof) dated Jun. 9, 2020 Bsued in International Application No. PCT/JP2018/039802.

Japanese Office Action dated Jul. 19, 2022, issued in counterpart Japanese Application No. 2017-235643.

Chinese Office Action dated Aug. 3, 2022 (and English translation thereof) issued in counterpart Chinese Application No. 201880078756.4.

* cited by examiner

FIG.6A

822 : 822a

| NAIL WIDTH | 8mm | 10mm | 12mm | 14mm | 16mm | 18mm | 20mm |
|---|---|---|---|---|---|---|---|
| ADJUSTMENT REGION WIDTH | 0.8mm | 1mm | 1.2mm | 1.4mm | 1.6mm | 1.8mm | 2mm |

FIG.6B

822 : 822b

| NAIL CURVED LEVEL | CURVED LEVEL 0 | CURVED LEVEL 1 | CURVED LEVEL 2 | CURVED LEVEL 3 | CURVED LEVEL 4 | CURVED LEVEL 5 |
|---|---|---|---|---|---|---|
| ADJUSTMENT REGION WIDTH (%) | 0 | 0 | 10 | 15 | 20 | 25 |

FIG.6C

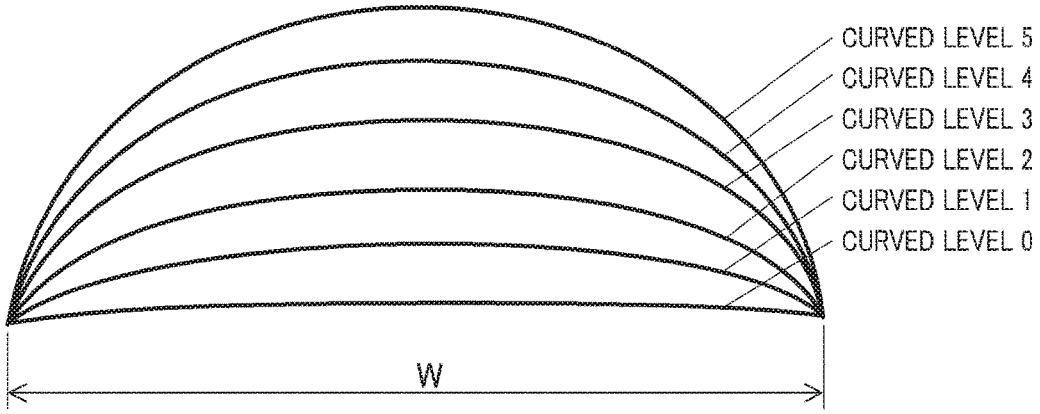

FIG.6D

822 : 822c

| FINGER TYPE | LEFT LITTLE FINGER | LEFT RING FINGER | LEFT MIDDLE FINGER | LEFT INDEX FINGER | LEFT THUMB | RIGHT LITTLE FINGER | RIGHT RING FINGER | RIGHT MIDDLE FINGER | RIGHT INDEX FINGER | RIGHT THUMB |
|---|---|---|---|---|---|---|---|---|---|---|
| ADJUSTMENT REGION PERCENTAGE (%) | 10 | 10 | 10 | 10 | 15 | 10 | 10 | 10 | 10 | 15 |

DRAWING DEVICE AND DRAWING METHOD

TECHNICAL FIELD

The present invention relates to a drawing device and a drawing method.

BACKGROUND ART

Conventionally, there has been known an inkjet type drawing device for drawing a nail design on a nail by ejecting a droplet of ink from a drawing head, for example, see Patent Document 1.

In such an inkjet type drawing device, by drawing using a first droplet having a relatively small droplet diameter and a second droplet having a larger droplet volume than a small droplet, drawing with high definition can be realized.

CITATION LIST

Patent Literature

Patent Document 1: WO2001/091598

SUMMARY OF INVENTION

Technical Problem

However, since the first droplet has a relatively short flyable distance, if the distance from the drawing head to the drawing target is long, the droplet may be misted even if landed, or the landing position may be disturbed, making it difficult to land in an accurate position.

The present invention has an advantage that it is possible to provide a drawing device and a drawing method capable of drawing in the entire area on a curved drawing target with high quality by discriminating drawing using the first droplet and drawing using the second droplet having a larger droplet volume than the first droplet.

Solution to Problem

In view of the above problems, according to an aspect of the present invention, a drawing device includes: a drawing head; and a processor which controls the drawing head. The drawing head draws an image by selectively forming a first droplet dot formed by a first droplet and a second droplet dot formed by a second droplet including a larger droplet amount than the first droplet on a drawing target surface curved convexly along a first direction. The processor controls the drawing head to form the second droplet dot in at least a part of an adjustment region in at least one end of ends in the first direction on the drawing target surface based on drawing data of the image. The drawing data is image data for drawing the image on a non-curved surface.

According to another aspect of the present invention, a drawing method is provided for a drawing device including a drawing head and a processor which controls the drawing head. The method includes: drawing an image by selectively forming a first droplet dot formed by a first droplet and a second droplet dot formed by a second droplet including a larger droplet amount than the first droplet on a drawing target surface curved convexly along a first direction, and controlling ejection by the drawing head to form the second droplet dot in at least a part of an adjustment region in at least one end of ends in the first direction on the drawing target surface based on drawing data which is image data of the image to be drawn on a non-curved surface.

Advantageous Effects of Invention

According to the present invention, by drawing selectively using the first droplet or using the second droplet having a larger droplet volume than the first droplet, it is possible to perform high-quality drawing on the entire area of the curved drawing target.

BRIEF DESCRIPTION OF DRAWINGS

FIG. 6A is a diagram illustrating an exemplary adjustment region setting table.

FIG. 6B is a diagram illustrating an exemplary adjustment region setting table.

FIG. 6C is a schematic view showing a cross section in a width of the nail at the respective curved levels.

FIG. 6D is a diagram illustrating an exemplary adjustment region setting table.

DESCRIPTION OF EMBODIMENTS

Figure 1:
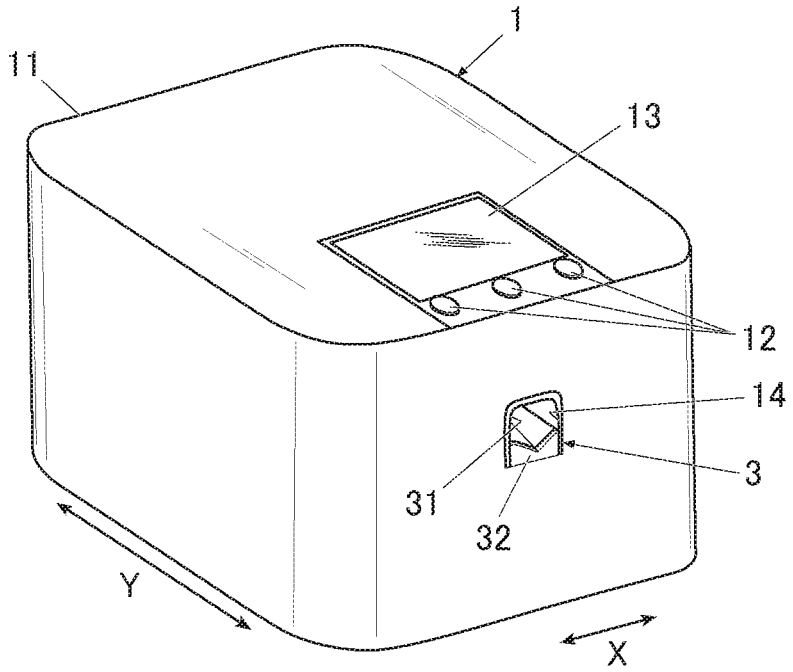
FIG. 1 is a perspective view showing an external configuration of a nail printing device according to the present embodiment.

An embodiment of a drawing device according to the present invention will be described with reference to FIG. 1 to FIG. 8.

The embodiments described below have various limitations which are technically preferable for carrying out the present invention, but the scope of the present invention is not limited to the following embodiments and illustrated examples.

In the following embodiment, the drawing device is a nail printing device in which a fingernail of a hand is to be a drawing target, a surface of the nail or a surface of a region to which ink is applied in the nail is to be a drawing target surface, and drawing is performed. However, the drawing target in the present invention is not limited to a fingernail of a hand, and for example, a fingernail of a toe may be used as a drawing target. In addition, an object other than a nail, such as a nail tip or a surface of various accessories, may be used as a drawing target.

FIG. 1 is an external perspective view of a nail printing device which is a drawing device according to the present embodiment.

As shown in FIG. 1, the nail printing device 1 according to the present embodiment has a case 11 substantially formed in a box shape.

An operation unit 12 is installed in the upper surface of the case 11 (top plate).

The operation unit 12 is an input unit through which a user performs various inputs.

Operation buttons for performing various inputs are arranged in the operation unit 12, for example, a power switch button for turning on the power of the nail printing device 1, a stop switch button for stopping the operation, a design selection button for selecting a design image to be drawn on the nail T, a drawing start button for instructing the start of the drawing, and the like.

Further, a display device 13 is provided on the upper surface of the case 11 (top plate).

The display device 13 may include, for example, a liquid crystal display (LCD: Liquid Crystal Display), an organic electroluminescent display or other flat display or the like.

In the present embodiment, the following are appropriately displayed on the display device 13, for example, a nail image obtained by imaging the finger U1 (image of a finger including an image of the nail T), an image such as a contour line of the nail T included in the nail image, an image in a state of projecting the original image to be described later on the nail T, a design selection screen for selecting a design image to be drawn on the nail T, a thumbnail image for design confirmation, an instruction screen for displaying various instructions, or the like.

A touch panel for performing various inputs may be integrally formed on the surface of the display device 13. In this case, the touch panel functions as the operation unit 12.

An imaging mechanism 50 (see FIG. 4) for imaging the nail T exposed from a window portion 33 and acquiring a nail image (an image of the finger U1 including the nail T) is provided at a position above the window portion 33 of a finger fixing portion 3, which will be described later, inside the upper surface (top plate) of the case 11.

The imaging mechanism 50 may be any mechanism capable of imaging the nail T arranged in the finger fixing portion 3, and the specific arrangement thereof is not particularly limited. For example, the imaging mechanism 50 may be fixed not to the inner surface of the case 11 but to any structural body disposed in the case 11, or may be fixed to a carriage or the like of a drawing mechanism 40 described later and configured to be movable by a head moving mechanism 49 (see FIG. 4) or the like. In this case, the imaging mechanism 50 is configured to be movable in the X-direction and Y-direction by the head moving mechanism 49 constituted by the X-direction moving motor 46 and the Y-direction moving motor 48.

In this manner, when the imaging mechanism 50 is configured to be movable by the head moving mechanism 49 or the like, the imaging mechanism 50 is positioned above the nail T exposed from the window portion 33 of the finger fixing portion 3 when the nail T is imaged as the drawing target. When the drawing is performed, the imaging mechanism 50 can be appropriately moved so that the drawing head 41 is arranged at the position above the finger fixing portion 3.

The imaging mechanism 50 is an imaging unit for imaging the nail T and acquiring a nail image which is an image of the finger U1 including the nail T.

The imaging mechanism 50 includes a camera 51 and a light 52.

The camera 51 is, for example, a small camera configured with a solid-state imaging element and a lens or the like having pixels about 2 million pixels or more.

The light 52 is, for example, a lighting lamp such as a white LED. According to the present embodiment, a plurality of lights 52 are disposed so as to surround the camera 51. Incidentally, the number and arrangement of the light 52 is not limited to the illustrative example.

The imaging mechanism 50 is connected to an imaging controller 811 of a control device 80 to be described later (see FIG. 4), so that the imaging mechanism 50 is controlled by the imaging controller 811.

The image data of the image captured by the image capturing mechanism 50 is stored in a later described nail image storage region 825, or the like.

Further, in a front side of the case 11 (the near side in FIG. 1) and in a substantially central portion in the X-direction (X-direction in FIG. 1) of the nail printing device 1, an opening 14 is formed to insert a finger U1 having a nail T that is a drawing target during imaging by the nail printing device 1 or during a drawing operation by the drawing mechanism 40, and to set the nail T in an imaging possible position where imaging by the imaging mechanism 50 is possible or a drawing position where drawing by the drawing mechanism 40 is possible.

Inside the opening 14, as described later, a finger fixing portion 3 for fixing the nail T (the finger U1 including the nail T) is disposed.

Figure 2:
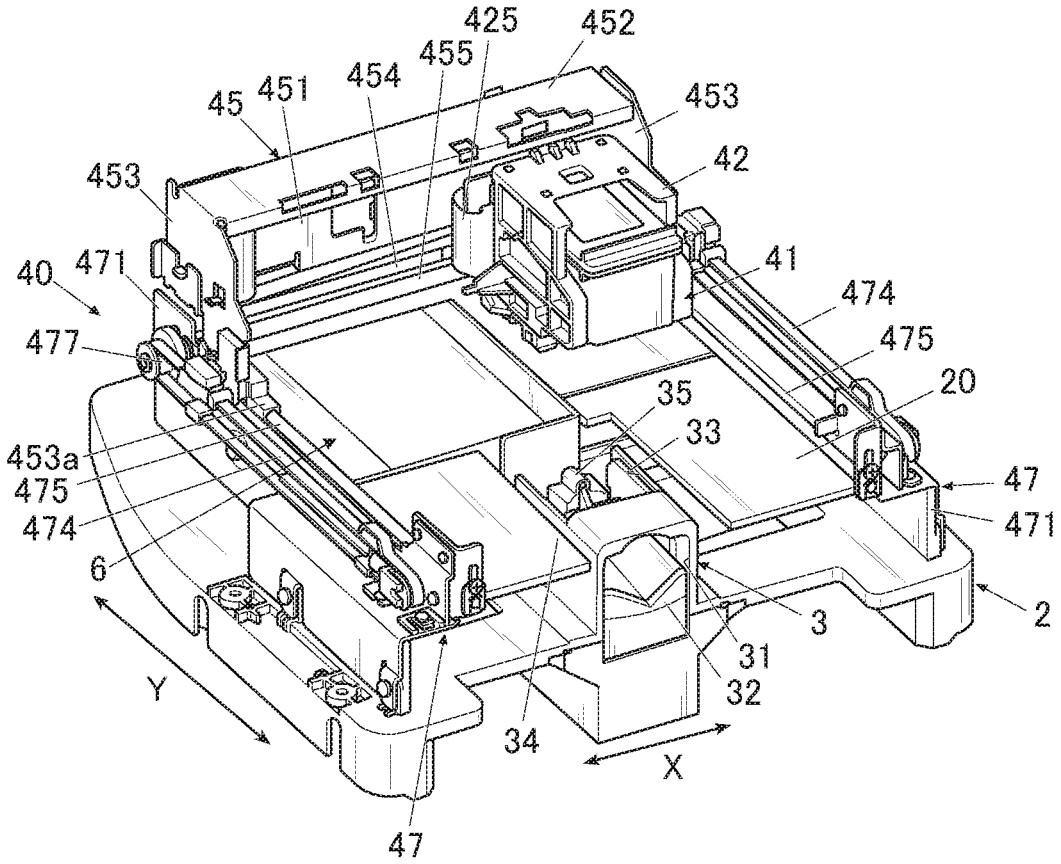
FIG. 2 is a perspective view of a main part showing an internal configuration of the nail printing device with the case removed from the nail printing device.

FIG. 2 is a main portion perspective view illustrating the internal configuration of the nail printing device 1 by removing the case 11 from the nail printing device 1 shown in FIG. 1.

As shown in FIG. 2, a base 2 in which various internal structures are included is provided in the case 11.

The surface of the base 2 (that is, the upper surface of the nail printing device 1 as shown in FIG. 2) has a base upper surface 20 constituting the XY plane in the present embodiment.

A standby region (not shown) in which the drawing head 41 stands by when drawing is not performed is provided on the base upper surface 20.

Further, a maintenance region 6 for performing maintenance of the drawing head 41 is provided in the base upper surface 20. Although illustration is omitted, in the maintenance region 6, for example, a maintenance mechanism such as a purge portion for forcibly ejecting ink from an ink ejecting surface (not shown) which is a surface facing a drawing target surface (surface of the nail T or a surface of a region to which ink is applied in the nail T in the present embodiment) in the drawing head 41, a wipe portion for wiping an ink ejecting surface and removing residual ink and the like are provided.

The finger fixing portion 3 is disposed at a position corresponding to the opening portion 14 of the case 11, which is a substantially central portion in the width direction (X-direction in FIG. 2) of the device, on the near side of the device on the base upper surface 20 (near side in the Y-direction in FIG. 2).

The finger fixing portion 3 is a box-shaped member having an opening 31 on the front side of the device, and a finger fixing member 32 for fixing the finger U1 is disposed inside the finger fixing portion 3.

The finger fixing member 32 pushes and supports the finger U1 from the lower side, and is formed of, for example, a flexible resin or the like. In the present embodiment, the finger fixing member 32 has a shape in which a substantially central portion in the width direction is recessed, and when the finger U1 is placed on the finger fixing member 32, the finger fixing member 32 can receive the ball portion of the finger U1 and prevent the finger U1 from rattling in the device width direction (X-direction in FIG. 1 and FIG. 2).

The finger fixing member 32 is not particularly limited as long as it can support the finger U1 from below. For example, it may be biased from below by an elastic member such as a spring. Further, for example, the finger fixing member 32 may be configured to be able to inflate and deflate by changing the internal pressure, and may be configured to push up the finger U1 in the inflated state and fix the position thereof.

The far side of the top surface of the finger fixing portion 3 is a window portion 33 which opens. The nail T of the finger U1 inserted into the finger fixing portion 3 is exposed from the window portion 33.

Further, the near side of the top surface of the finger fixing portion 3 has a finger presser 34 for regulating the upward position of the finger U1 to prevent the floating of the finger U1. The finger U1 and its nail T are supported by the finger fixing member 32 from the lower side, and the upper side of the finger U1 is pressed by the finger presser 34. With this, the position in the height direction is determined at a predetermined position.

Further, in the present embodiment, a nail placing portion 35 for placing the nail T is provided on the far side in the finger insertion direction.

By placing the tip of the nail T on the nail placing portion 35, the position of the nail T in the horizontal direction (that is, the X-direction and the Y-direction) is defined, and the position of the nail T in the height direction is also regulated.

Further, the drawing mechanism 40 (see FIG. 4) for applying a drawing on the drawing target surface is provided inside the case 11. Here, the drawing target surface is the surface of the drawing target, and in the present embodiment, the drawing target surface is the surface of the nail T of the finger U1.

The drawing mechanism 40 is configured to include a drawing head 41 which is a drawing mechanism main body, a head carriage 42 supporting the drawing head 41, an X-direction moving stage 45 and an X-direction moving motor 46 (see FIG. 4) for moving the drawing head 41 in the X-direction (X-direction in FIG. 1 and FIG. 2, or the like, the left to right direction of the nail print device 1), a Y-direction moving stage 47 and a Y-direction moving motor 48 (see FIG. 4) for moving the drawing head 41 in the Y-direction (Y-direction in FIG. 1 and FIG. 2, or the like, the front to back direction of the nail print device 1), or the like.

The Y-direction moving stage 47 has support members 471 each of which are provided extending in the Y-direction (Y-direction in FIG. 1 and FIG. 2 or the like, the front to back direction of the nail printing device 1) on both sides in the device width direction (X-direction in FIG. 1 and FIG. 2 or the like, the left to right direction of the nail printing device 1) on the base top surface 20.

Pulleys 477 are respectively attached to both ends in the extending direction of the pair of support members 471. Drive belts 474 extending in the front to back direction of the device (Y-direction in FIG. 2 or the like) are wound around each of the pulleys 477 on the left side of the device and on the right side of the device.

The pulleys 477 provided on the far side of the device are attached to both ends of the drive shaft portion 476. The Y-direction moving motor 48 (see FIG. 4) is connected to the drive shaft portion 476, and the drive shaft portion 476 and the pulleys 477 mounted thereto are driven by the Y-direction moving motor 48 to rotate appropriately in the forward and reverse directions.

The rotation of the pulley 477 also rotates the drive belt 474 wound around the pulley 477, thereby allowing the X-direction moving stage 45 (and the drawing head 41 mounted on the X-direction moving stage 45) to move in the Y-direction.

Further, a guide shaft 475 extending in the Y-direction parallel to the drive belt 474 is provided on the support member 471.

The X-direction moving stage 45 includes a back plate 451 which is erected with respect to the base upper surface 20 on the device far side and which extends in the X-direction of the base 2, an eave portion 452 projecting from the upper end portion of the back plate 451 to the front of the device, and a pair of side portions 453 which are respectively erected so as to close both sides of a substantially L-shaped portion from the side view composed of a back plate 451 and the eave portion 452.

Shaft insertion portions 453*a* each in which a guide shaft 475 is inserted are provided in the pair of left and right side portions 453, the guide shaft 475 is inserted into each of the pair of shaft insertion portions 453*a*, the Y-direction drive motor 48 is driven and the drive belt 474 is rotated. With this, the X-direction moving stage 45 is able to move along the guide shaft 475 in the Y-direction.

Further, pulleys (not shown) connected with the X-direction moving motor 46 are provided on the inside of the pair of side portions 453, and the drive belt 454 extending in the left to right direction of the device (X-direction in FIG. 2 or the like) is wound around the pulleys. Further, on the inside of the X-direction moving stage 45, the guide shaft 455 extending in the X-direction of the base 2 substantially parallel to the drive belt 454 is provided.

A head carriage 42 which supports the drawing head 41 is mounted on the X-direction moving stage 45.

A shaft insertion portion (not shown) in which the guide shaft 455 is inserted is provided on the back side of the head carriage 42 (device far side).

The guide shaft 455 is inserted into the shaft insertion portion of the head carriage 42, and the X-direction drive motor 46 is driven to rotate the drive belt 454. With this, the head carriage 42 is able to move in the X-direction moving stage 45 along the guide axis 455 in the X-direction.

Figure 4:
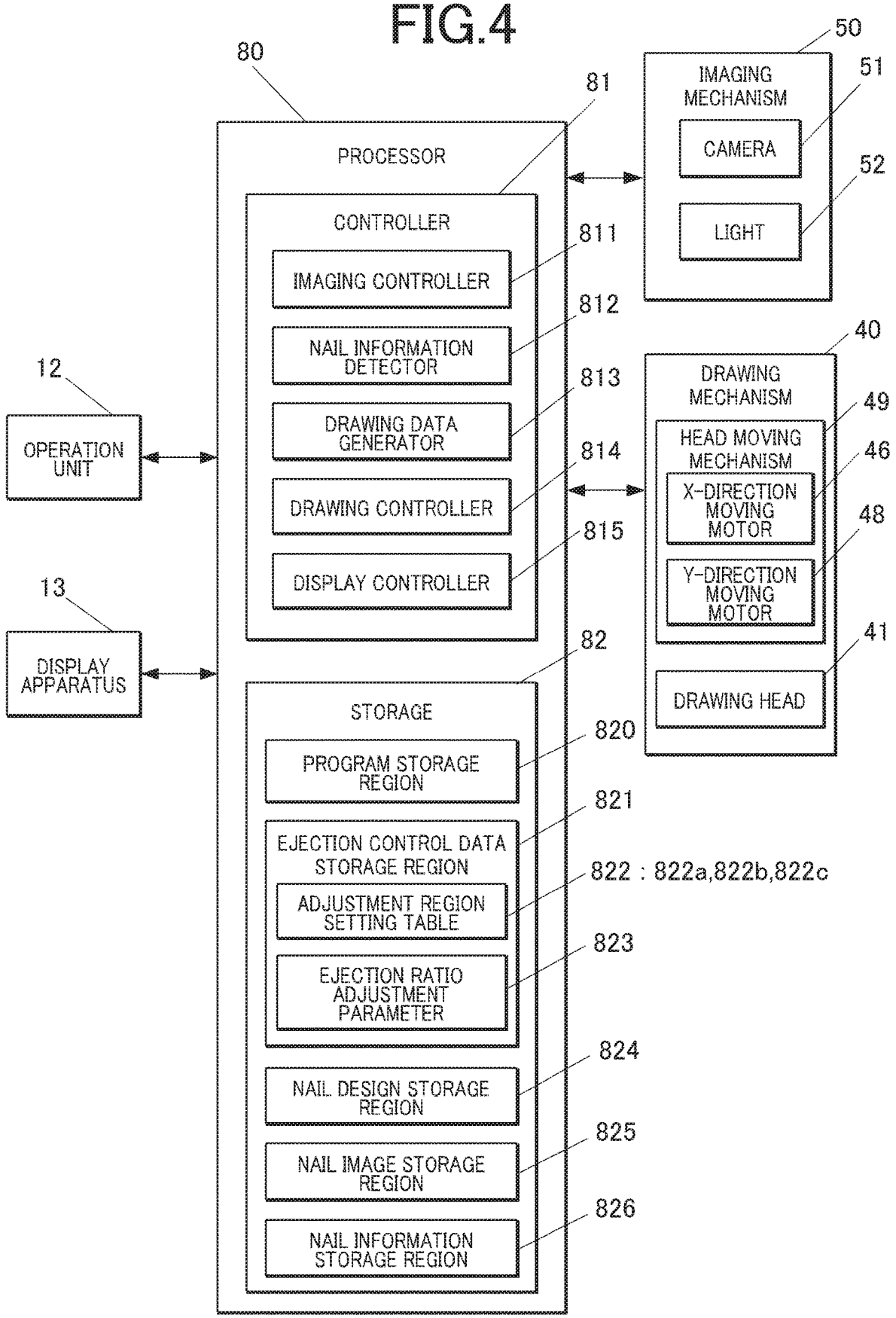
FIG. 4 is a main part block diagram showing a control configuration of the nail printing device according to the present embodiment.

In the present embodiment, the X-direction moving motor 46 and the Y-direction moving motor 48 are included in the head moving mechanism 49 which can move the drawing head 41 in the X and Y directions on the XY plane (see FIG. 4). The operation is controlled by the control device 80 to be described later (specifically, drawing controller 814).

The entire drawing controller 814 for controlling the operation of the drawing head 41 and the operation of the head moving mechanism 49 need not be provided on one control board. For example, a processor 81 for controlling the ink ejection of the drawing head 41 and the operation of the X-direction moving motor 46 may be mounted, and a control board (not shown) which is electrically connected to the main control board may be provided in the X-direction moving stage 45. On the back side of the head carriage 42 according to the present embodiment, a flexible printed wiring board 425 is provided. The printed wiring board 425 is electrically connected to a control board provided in the X-direction moving stage 45, the control signal from the drawing controller 814 provided on the main control board is sent to the printed wiring board 425 via the control board provided in the X-direction moving stage 45, and the ink ejection control of the drawing head 41 according to the control of the drawing controller 814 is performed.

Figure 3:
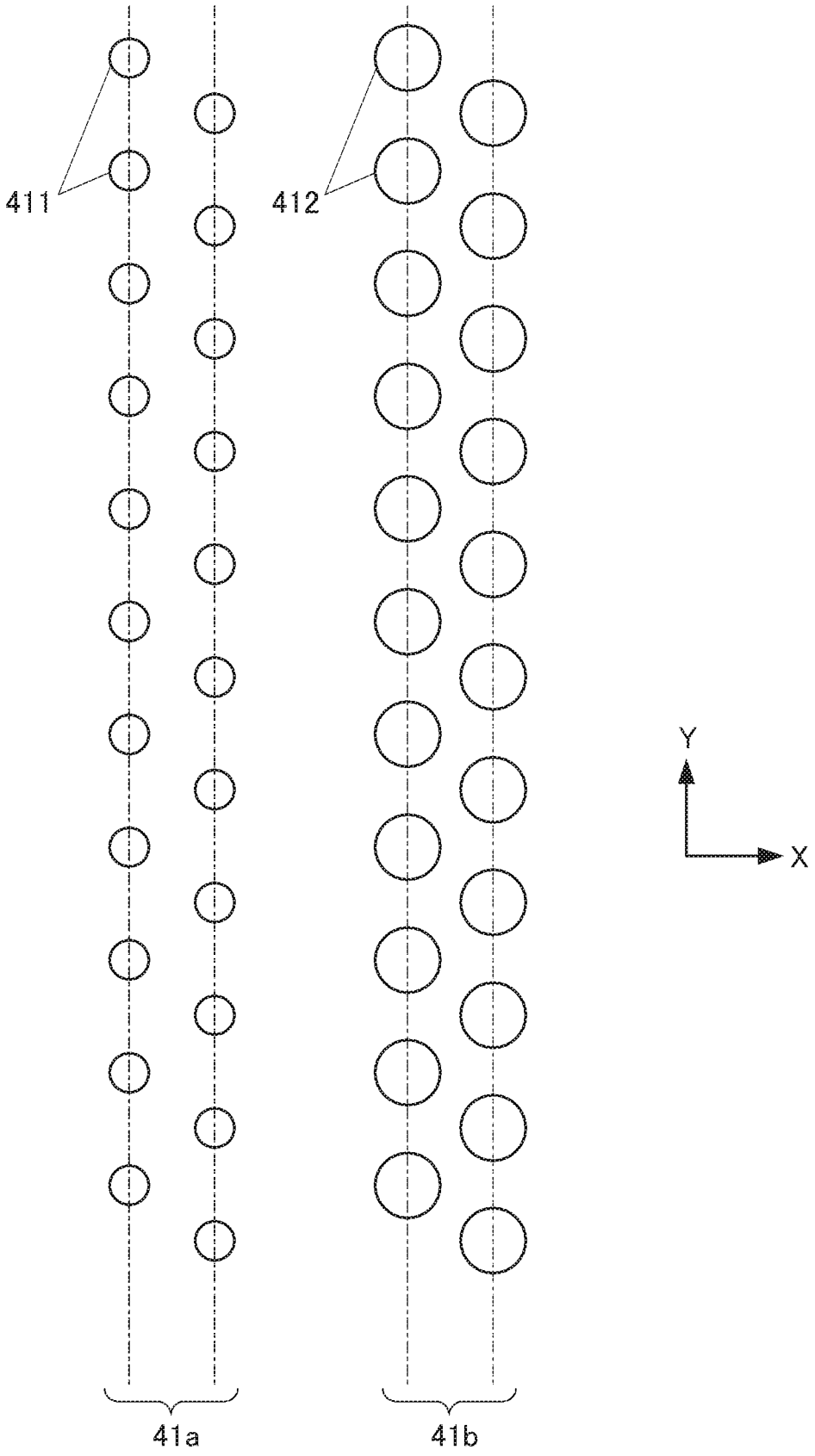
FIG. 3 is a diagram illustrating a nozzle arrangement of a drawing head.

The drawing head 41 of the present embodiment is an inkjet head that performs drawing in an inkjet method, and FIG. 3 is a diagram illustrating an example of a nozzle arrangement in the drawing head 41.

The drawing head 41 is, for example, an ink cartridge integrated head in which an ink cartridge (not shown) corresponding to yellow (Y; YELLOW), magenta (M; MAGENTA), and cyan (C; CYAN) inks and an ink ejection surface provided on a surface opposed to the drawing target surface in the respective ink cartridges are integrally formed. As shown in FIG. 3, ejection openings (ink ejection opening, 411, 412) of the nozzle array including a plurality of nozzles for ejecting droplets of ink of respective colors are formed in rows on the ink ejection surface. The drawing head 41 performs drawing by forming ink droplets and directly ejecting ink droplets from an ink ejection surface (ink ejection openings by a plurality of nozzles of the ink ejection surface) onto the drawing target surface (that is, the surface of the nail T or the surface of a region of the nail T where ink is applied). The drawing head 41 is not limited to ejecting droplets of the three colors of ink. An ink cartridge for storing ink of other colors and an ink ejection opening may be provided.

The drawing head 41 performs drawing on the nail T of the finger U1 based on the nail information and the like detected by a nail information detector 812, which will be described later.

In the present embodiment, the drawing head 41 is configured to be capable to selectively eject a first droplet (small droplet) or a second droplet (large droplet) having a larger droplet volume than the first droplet (small droplet). That is, in the drawing head 41, for example, a first nozzle group 41*a* of a plurality of first nozzles 411 having small diameters for ejecting the first droplets and a second nozzle group 41*b* of a plurality of second nozzles 412 having large diameters for ejecting the second droplets are formed, and in accordance with the control of the drawing controller 814, ink is ejected from either of the nozzle groups. Here, dots formed on the drawing target surface by ejecting the first droplet from the first nozzle 411 of the drawing head 41 are referred to as first droplet dots (small droplet dots), and dots formed on the drawing target surface by ejecting the second droplet from the second nozzle 412 of the drawing head 41 are referred to as second droplet dots (large droplet dots).

Here, the second droplet is, for example, a droplet having a landing diameter of 940 μm or more, and the first droplet is, for example, a droplet having a landing diameter of φ30 μm or less.

The first droplet lands almost accurately at the desired position on the drawing target surface if the flight distance is up to about 5 mm, enabling high-definition drawing. However, if the flight distance exceeds 5 mm, it becomes difficult to accurately land in the desired position, the drawn image is distorted, and the image quality deteriorates remarkably. In addition, as the flight distance increases, the first droplet gradually becomes mist and scatters into the air without even landing, so that the density of the drawn image decreases. On the other hand, in the case of drawing with the second droplet having a larger droplet volume than the first droplet, an image having granularity compared to the first droplet is obtained, but even if the flight distance exceeds 5 mm, the droplet can be landed at a desired position almost accurately, so that the drawn image is less disturbed and the density of the drawn image is less reduced.

The control device 80 is installed on a board (not shown) disposed on the lower surface side of the case 11 top surface, for example. In the present embodiment, as described above, in addition to the main board disposed on the lower surface side of the case 11 top surface, the board is also provided distributed in the X-direction moving stage 45 and the head carriage 42, etc. These parts are electrically connected so that the parts are controlled comprehensively, and the parts operate in conjunction with each other.

FIG. 4 is a main part block diagram showing a control configuration in the present embodiment.

The control device 80 is a computer including a processor 81 constituted by a CPU (Central Processing Unit) not shown, a storage 82 including a ROM (Read Only Memory) and a RAM (Random Access Memory) (both not shown), and the like, as shown in FIG. 4.

Various programs and various data for operating the nail printing device 1 are stored in the storage 82.

Specifically, the program storage region 820 composed by the ROM in the storage 82 stores various programs, for example, the nail information detecting program for detecting various nail information from the nail image such as the shape and contour of the nail T, the width of the nail T, the curvature of the nail T, etc., a drawing data generating program for generating drawing data, and a drawing program for performing the drawing process. These programs are executed by the control device 80, so that each unit of the nail printing device 1 is centrally controlled.

In the present embodiment, the storage 82 is provided with an ejection control data storage region 821 for storing data such as parameters related to ejection control of droplets by ink in the present embodiment, a nail design storage region 824 for storing image data of a nail design drawn on the nail T, a nail image storage region 825 for storing a nail image of the nail T of the user's finger U1 acquired by the imaging mechanism 50, a nail information storage region 826 for storing nail information (the contour of the nail T, the width of the nail T, the inclination angle of the nail T (the curvature of the nail T), and the like) detected by the nail information detector 812, and the like.

In the present embodiment, an adjustment region setting table 822 (see FIG. 6A to FIG. 6C), an ejection ratio adjusting parameter 823, and the like are stored in the ejection control data storage region 821. In the present embodiment, the adjustment region setting table 822 or the like is defined in accordance with the curved level of the nail T as shown in FIG. 6C (in FIG. 6C, six stages of the curved surface level 5 from the curved surface level 0).

Details of the adjustment region setting table 822 and the ejection ratio adjustment parameter 823 will be described later.

When viewed functionally, the processor 81 includes the imaging controller 811, the nail information detector 812, a drawing data generator 813, the drawing controller 814, a display controller 815, and the like. The functions of the imaging controller 811, the nail information detector 812, the drawing data generator 813, the drawing controller 814, the display controller 815, and the like are realized by the cooperation of the CPU of the processor 81 and the program stored in the program storage region 820 of the storage 82.

The imaging controller 811 controls the camera 51 and the light 52 of the imaging mechanism 50 to allow the camera 51 to image an image of a finger including an image (nail image) of the nail T of the finger U1 fixed to the finger fixing portion 3. The nail T of the finger U1 has a state of a raw nail to which nothing is applied, a state in which, for example, white base ink is applied, and a state in which a nail design is drawn on a region to which the base ink is applied.

The image data of the nail image acquired by the imaging mechanism 50 is stored in the nail image storage region 825 of the storage 82.

The nail information detector 812 detects nail information about the nail T of the finger U1 based on an image (nail image) of the nail T of the finger U1 fixed to the finger fixing unit 3 imaged by the camera 51.

Here, the nail information includes, for example, the contour of the nail T (nail shape, XY coordinates of the horizontal position of the nail T, and the like), the height of the nail T (the position of the nail T in the vertical direction, hereinafter referred to as the "vertical position of the nail T" or simply as the "position of the nail T"), the curvature (degree of curvature) of the nail T, and the like.

The nail information may include a finger type of the nail T (for example, information of a thumb of a right hand, a middle finger of a left hand, or the like). These pieces of information may be detected by analyzing the nail image with the nail information detector 812, or may be input by the user from the operation unit 12 or the like.

In the present embodiment, the nail-information detector 812 detects the nail width (the nail width W in FIG. 5A and FIG. 5B) when the nail T as the drawing target is viewed from above. In the examples shown in FIG. 5A, the nail T is in a raw nail condition in which nothing is applied, and when the nail T is viewed from above, the length (width dimension) between the nail end portions a and b which are positions where the end portions of the nail T in the width direction separate from a nail bed (the skin of the fingertip with which the nail and the skin are in close contact) of the finger U1 and which are on both sides of the nail T in the width direction is defined as the nail width W. In the case where the base ink is applied to the nail T, the surface of the region of the nail T to which the base ink is applied is regarded as the drawing target surface. Here, the end in the width direction of the nail T in the region where the base ink is applied may be located at a position inside toward the direction of the center of the nail T more than the nail bed of the nail T. In this case, the width dimension in the width direction of the nail T in the region where the base ink is applied is defined as the nail width W.

The width dimension of any portion of the nail T or the region where the base ink is applied can be suitably set as the nail width W, and for example, the dimension of the widest portion in the width direction of the nail T may be set as the nail width W.

The nail information such as the nail shape (contour of the nail T), the nail width W, the nail curvature, and the finger type, which are the results detected by the nail information detector 812, is stored in the nail information storage region 826 of the storage 82.

The drawing data generator 813 generates drawing data to be applied to the nail T of the finger U1 by the drawing head 41 based on the nail information detected by the nail information detector 812.

Specifically, the drawing data generator 813 performs matching processing for matching the nail design image data to the shape of the nail T by performing enlarging, reducing, cutting out, or the like on the nail design image data based on the shape or the like of the nail T detected by the nail information detector 812.

Further, the drawing data generator 813 generates drawing data to be drawn on the drawing target surface by performing appropriate correction.

When the curvature or the like of the nail T has been acquired by the nail information detector 812, the drawing data generator 813 may appropriately perform curvature correction such as density adjustment so that the density of the image drawn at both end portions of the nail T does not decrease in accordance with the curvature of the nail T, for example.

As will be described later, in the present embodiment, the ejection ratio of the first droplet ink and the second droplet is adjusted in a predetermined range of both end portions of the nail T, and it is also possible to make the density of the drawn image darker as it goes to the end portion of the nail T. In this case, it is not necessary to perform surface correction at the stage of creating drawing data.

As will be described later, the drawing data that is not subjected to the curved surface correction is the drawing data that is made on the assumption that it is drawn on a surface (plane) that is not curved, such as paper, and is set so that both the second droplet nozzle for ejecting the second droplet and the first droplet nozzle for ejecting the first droplet eject the droplets of the ink at 100%.

The drawing controller 814 outputs a control signal to the drawing mechanism 40 based on the drawing data generated by the drawing data generator 813, and is a controller for controlling the X-direction moving motor 46, the Y-direction moving motor 48, the drawing head 41, and the like in the drawing mechanism 40 so as to perform the drawing according to the drawing data on the nail T.

In this embodiment, the drawing controller 814 sets the adjustment region CA that increases the ejection ratio of the second droplet ink to the end portion region that faces the central portion from both end portions a and b (see FIG. 5A, etc.) in the width direction of the nail T, and controls the ejection of the droplet of the ink from the drawing head 41 so as to increase the ejection ratio of the second droplet in this adjustment region CA.

More specifically, the drawing controller 814 sets an adjustment region CA having a predetermined width (width P in FIG. 5B or the like) in the end portion region of the nail T based on the various types of nail information detected by the nail information detector 812 and the adjustment region setting table (see FIG. 6A to FIG. 6B) stored in the ejection control data storage region 821 of the storage 82.

In addition, the drawing controller 814 of the present embodiment is adapted to adjust the ratio of the ejection amount of the first droplet and the second droplet to the drawing target surface on the basis of the ejection ratio adjustment parameter 823 stored in the ejection control data storage region 821 within the set adjustment region CA.

First, while referring to FIG. 5A and FIG. 5B and FIG. 6A to FIG. 6C, the setting of the adjustment region CA by the drawing controller 814 will be described.

Figure 5A:
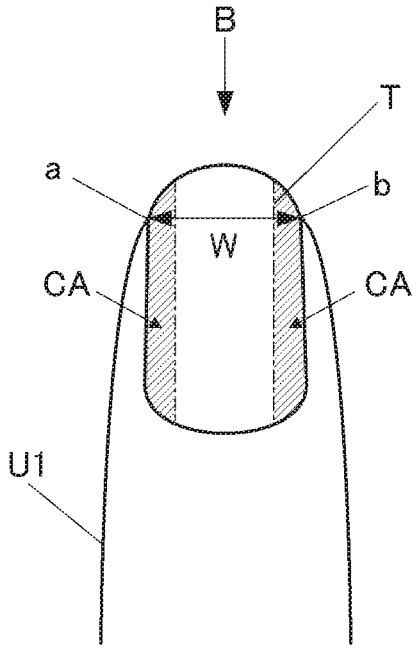
FIG. 5A is a plan view of a fingernail.
Figure 5B:
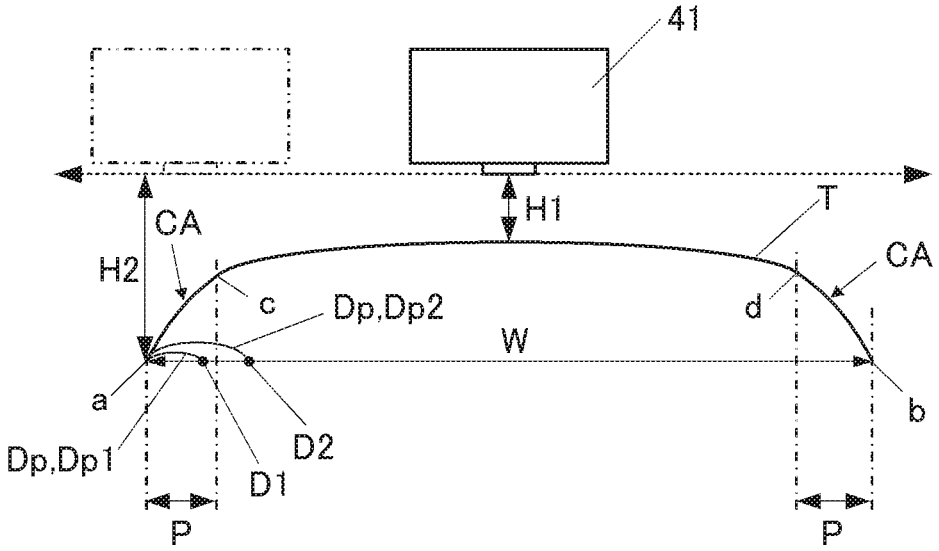
FIG. 5B is an explanatory view schematically showing the positional relationship between a nail and the drawing head viewed from the arrow B direction in 5A.

FIG. 5B is an explanatory view schematically showing the positional relationship between the nail T and the drawing head 41 as viewed from the arrow B direction in FIG. 5A.

As shown in FIG. 5B, the surface of the nail T, which is the drawing target surface, or the surface of the region of the nail T to which the ink is applied, has a curved surface shape in which the height of central portion in the width direction is high and the height of the both end portions is low. Therefore, in the central portion of the nail T in the width direction, the distance between the drawing head 41 and the surface of the nail T is small (distance H1 in FIG. 5B), but in both end portions of the nail T in the width direction, the distance between the drawing head 41 and the surface of the nail T increases (distance H2 in FIG. 5B).

For example, in the nail printing device 1, when the distance H1 from the drawing head 41 to the central portion of the nail T is set to 2 mm, the distance H2 from the drawing head 41 to the end portion of the nail T is about 5 mm to 8 mm. As described above, when the flight distance of the first droplet exceeds 5 mm, it becomes difficult for the first droplet to accurately land at a desired position. Therefore, in the vicinity of the end portion of the nail T, accurate landing is difficult with the first droplet, but the second droplet can be landed almost accurately at a desired position.

Therefore, in the present embodiment, a table 822*a* associating the nail width W with the width of the adjustment region CA as shown in FIG. 6A ("P" in FIG. 5B) is provided as the adjustment region setting table 822, and the drawing controller 814 is adapted to set the width P of the adjustment region CA corresponding to the nail width W with reference to the adjustment region setting table 822*a* shown in FIG. 6.

The value of the width P is a value when the surface of the nail T is the drawing target surface, and the adjustment region CA is set to have a width P from both end portions of the nail T in the width direction (nail end portions a, b in FIG. 5A and FIG. 5B) to the position toward the central portion of the nail in the width direction T. Here, when the drawing target surface is the surface of the region of the nail T to which the base ink is applied, and the end of the nail T in the width direction in the region to which the base ink is applied is located in a position toward the center direction of the nail T from the nail floor of the nail T, the width P of the adjustment region CA is adjusted in accordance with the position of the end of the nail T in the width direction in the region of the nail T in which the base ink is applied.

In the following description, the case where the drawing target surface is the surface of the nail T will be described, but the same control method can be applied to the case where the drawing target surface is the surface of the region of the nail T to which ink has been applied. For example, in the adjustment region setting table 822*a* shown in FIG. 6A, the nail width W is corresponded with the width P of the adjustment region CA so that when the nail width W is 8 mm, the width P of the adjustment region CA is set to 0.8 mm, and when the nail width W is 20 mm, the width P of the adjustment region CA is set to 2 mm.

In the case where the table is configured with such specific numerical values, since the drawing controller 814 only needs to read out the numerical value corresponding to the matching nail width W, it is possible to save the calculation processing time and the like as compared with the case where the numerical value indicating the ratio of the width of the adjustment region CA to the nail width W is used as the parameter.

When the detected nail width W does not match any of the plurality of nail widths W defined in the adjustment region setting table 822*a*, a numerical value corresponding to the nail width W most approximate to the detected nail width W in the plurality of nail widths W defined in the adjustment region setting table 822*a* may be read as the width P of the adjustment region CA, or a value for the nail width W defined in the adjustment region setting table 822*a* may be proportionally calculated according to the difference between each nail width W and the detected nail width W, and the calculated value may be set as the width P of the adjustment region CA.

The adjustment region setting table 822*a* shown in FIG. 6A is one example, and the method of defining the width P of the adjustment region CA corresponding to the nail width W is not limited to the above.

Although the adjustment region setting table 822*a* is configured by a specific numerical value, for example, the relationship between the nail width W and the width P of the adjustment region CA may be defined by a ratio. In this case, for example, when the nail width W is 8 mm, the width P of the adjustment region CA is set to 10% of the nail width W, and when the nail width W is 20 mm, the width P of the adjustment region CA is set to 20% of the nail width W, and when the nail width W is 8 mm, a region having a width of 0.8 mm from both end portions a and b in the width direction of the nail T is set as the adjustment region CA, and when the nail width W is 20 mm, a region having a width of 4 mm from both end portions a and b in the width direction of the nail T is set as the adjustment region CA.

In the case where the relationship between the nail width W and the width P of the adjustment region CA with respect to the nail width W is defined by a ratio as described above, it is possible to widely cope with nails T having various widths than in the case where a table is configured by a specific numerical value.

In addition, the width P of the adjustment region may be set in accordance with the curvature of the nail T detected by the nail information detector 812. In this instance, an adjustment region setting table 822*b* shown in FIG. 6B is prepared in the ejection control data storage region 821.

The higher the curved level of the nail T, the greater the fall of the end portions a and b of the nail T, and the first droplet becomes difficult to land. Therefore, it is preferable to adjust the ratio (ejection ratio) of the ejection amounts of the first droplet and the second droplet with a wider width.

Therefore, for example, in the adjustment region setting table 822*b* shown in FIG. 6B, the curved level of the nail T is divided into six stages from the curved level 0 in which the nail T is hardly curved to the curved level 5 in which the nail T is largely curved, and when the nail T is not substantially curved or when the nail T is the curved level 0 or 1 in which the nail T is relatively less curved, the width P of the adjustment region CA is set to 0%, and the adjustment region CA is not set.

In contrast, in the case of the curved level 2, the width P of the adjustment region CA is set to 10%, and the drawing controller 814 sets a region which is 10% of the width from each end portion a and b in the width direction of the nail T as the adjustment region CA. Further, in the case of the curved level 5, the width P of the adjustment region CA is set to 25%, and the drawing controller 814, sets a region which is 25% of the width from each end portion a and b in the width direction of the nail T as the adjustment region CA.

Note that the curved level is not limited to the six levels shown here, and may be further finely divided, or may be largely divided into three levels or the like.

The nail information detector 812 may determine which curved level the surface of the nail T as the drawing target surface belongs to and the curved level information may be stored in the nail information storage region 826 as nail information of the nail T. Alternatively, the drawing controller 814 may classify the nail T into the respective curved levels 0 to 6 based on the curvature of the nail T detected by the nail information detector 812 as shown in FIG. 6C and may apply the adjustment region setting table 822*b* as shown in FIG. 6B based on the classified result.

In addition, the width P of the adjustment region CA may be set according to a finger type detected by the nail information detector 812 (type of the finger U1 corresponding to the nail T). In this instance, an adjustment region setting table 822*c* shown in FIG. 6D is prepared in the ejection control data storage region 821.

The shape and size of the nail T are characterized by the type of finger, for example, the little finger is relatively flat and the nail width W is narrow, whereas the thumb has a relatively large curved level of the nail T and the nail width W is wide.

For this reason, it is preferable to set the adjustment region CA in a wider range for the thumbnail T than for the other fingernails T.

Therefore, for example, in the adjustment region setting table 822*c* shown in FIG. 6D, for nails other than the nail T of the left and right thumbs, a region which is 10% of the width from each end portions a and b in the width direction of the nail T is set as the adjustment region CA. In contrast, in the case of the nail T of the right and left thumbs, the width P of the adjustment region CA is set to 15%, and the drawing controller 814 sets a region which is 15% of the width from each end portion a and b in the width direction of the nail T as the adjustment region CA, respectively.

The width P of the adjustment region CA corresponding to the finger types are not limited to the examples shown in FIG. 6D.

All of the adjustment region setting tables 822*a* to 822*c* may be stored in the ejection control data storage region 821, or some of the adjustment region setting tables 822*a* to 822*c* may be stored in the ejection control data storage region 821.

If a plurality of types of adjustment region setting tables 822 are stored in the ejection control data storage region 821, one is set as the default. Unless changed by the user or the like, the drawing controller 814 may set the adjustment region CA using the adjustment region setting table 822 set by default. Alternatively, a plurality of types of adjustment region setting tables 822 may be referred together to set the adjustment region CA. Further, the drawing controller 814 may select any of the adjustment region setting tables 822 according to various conditions.

The adjustment region setting table 822 stored in the ejection control data storage region 821 is not limited to the adjustment region setting tables 822*a* to 822*c* exemplified here, and may take other factors into consideration.

For example, the adjustment region may be set according to the depth of the end portions a and b of the nail T (for example, the distance of H2-H1 in FIG. 5B), or the height dimension of the nail T. Since the landing rate of the first droplet decreases as the height of the nail T increases, by setting the adjustment region CA based on the shape in the height direction of the nail T, it is possible to supplement the place where the landing rate of the first droplet falls with the second droplet.

In addition, the width P of the adjustment region CA set by the drawing controller 814 referring to the adjustment region setting table 822 may be changeable afterwards.

For example, when drawing is performed on the nail T and the user desires to narrow or widen the width P of the adjustment region CA based on the drawing result, the width P of the adjustment region CA defined by default by the adjustment region setting table 822 may be changed by operating the operation unit 12 or the like.

In this case, specifically, an adjustment region width change switch or the like capable of inputting change to plus or minus, for example, is provided in the operation unit 12 or the like, and each time the user operates the adjustment region width change switch once, the processor 81 accepts the instruction to change the threshold of the width P of the adjustment region CA set by default to plus direction or minus direction by one level at a time.

For example, when 10% of the nail width W in the end portion is set as the adjustment region CA due to the adjustment region setting table 822*b* for the nail T being determined to be the curved surface level 2, if the user operates the adjustment region width changing switch once in the plus direction, the setting of the width P of the adjustment region CA is changed to 11% of the nail width W in the end portion. Conversely, when the user wants to narrow the width P of the adjustment region CA, if the adjustment region width changing switch is operated once in the minus direction, the setting of the width P of the adjustment region CA is changed to 9% of the end portion in the nail width W. The information after the change may be stored in the ejection control data storage region 821 as a new adjustment region setting table 822 specific to the user, or the default table 822 may be updated by user operation.

In this manner, when the default table 822 can be changed in response to an input instruction from the operation unit 12, it is possible to realize a nail print with a finish according to the user's preference.

The adjustment region CA set by the drawing controller 814 may be displayed on a display device or the like superimposed on the nail image or the like. As a result, the user can confirm in which range of the nail T the adjustment region CA is set, and can easily correct or finely adjust the width P of the adjustment region CA.

Next, referring to FIG. 7A to FIG. 7C, the adjustment of the ejection ratio of the second droplet to the first droplet dot formation region and the adjustment of the ejection ratio of the first droplet to the first droplet dot formation region by the drawing controller 814 will be described.

Here, the ejection ratio of the second droplet to the first droplet dot formation region indicates a ratio of ejecting the second droplet from the second droplet nozzle 412 to form the second droplet dot to the region (first droplet dot formation planned region) where the first droplet dot is to be formed based on the drawing data, when the state of ejecting the second droplet from the second droplet nozzle 412 based on the drawing data is 0% in the region (second droplet dot formation planned region) where the second droplet is to be formed based on the created drawing data. That is, for example, when the ejection ratio of the second droplet is 10%, it means that the second droplet is ejected to form the second droplet dot in a region which is 10% of the first droplet dot formation planned region, when the ejection ratio of the second droplet is 50%, it means that the second droplet is ejected to form the second droplet dot in 50% among the plurality of places defined to form the first droplet dot, that is, one place out of two places, and when the ejection ratio of the second droplet is 100%, it means that the second droplet is ejected to form the second droplet dot in all of the plurality of places formed to form the first droplet dot. Here, when the ejection ratio of the second droplet is not 100%, the position where the second droplet dot is formed is not particularly limited among the plurality of positions set to form the first droplet dot, but it is preferable that the position where the second droplet dot is formed is not biased, and it is preferable that the position where the second droplet dot is formed is randomly selected from the plurality of positions set to form the first droplet dot.

In addition, the ejection ratio of the first droplet to the first droplet dot formation planned region indicates the ratio of ejecting the first droplet from the first droplet nozzle 411 to form the first droplet dot to the first droplet dot formation planned region, when the state in which the first droplet is ejected from the first droplet nozzle 411 in accordance with the drawing data is 100% in all of the regions in which the first droplet dot is to be formed (first droplet dot formation planned region) based on the created drawing data. That is, when the ejection ratio of the first droplet to the first droplet dot formation planned region is 10%, the first droplet dot is formed in the region of 10% of the first droplet dot formation planned region, and the first droplet dot is not formed in the remaining portion. When the ejection ratio of the first droplet to the first droplet dot formation planned region is 50%, the first droplet dot is formed in the region of 50% of the first droplet dot formation planned region, and the first droplet dot is not formed in the remaining portion. When the ejection ratio of the first droplet to the first droplet dot formation planned region is 0%, the first droplet dot is not formed in the first droplet dot formation planned region. Here, when the ejection ratio of the first droplet to the first droplet dot formation planned region is less than 100% and not 0%, the position where the first droplet dot is formed in the first droplet dot formation planned region is set to a position that differs from the position where the second droplet is formed in accordance with the ejection ratio of the second droplet to the first droplet dot formation planned region, as shown in FIG. 7A and FIG. 7B.

Figure 7A:
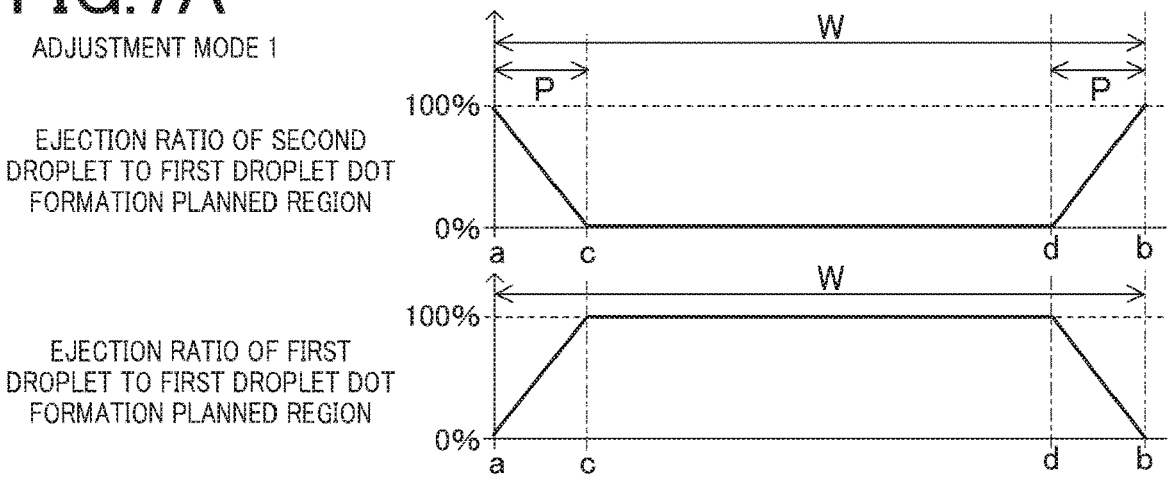
FIG. 7A is a diagram schematically showing an exemplary adjustment process of the ejection ratio.
Figure 7B:
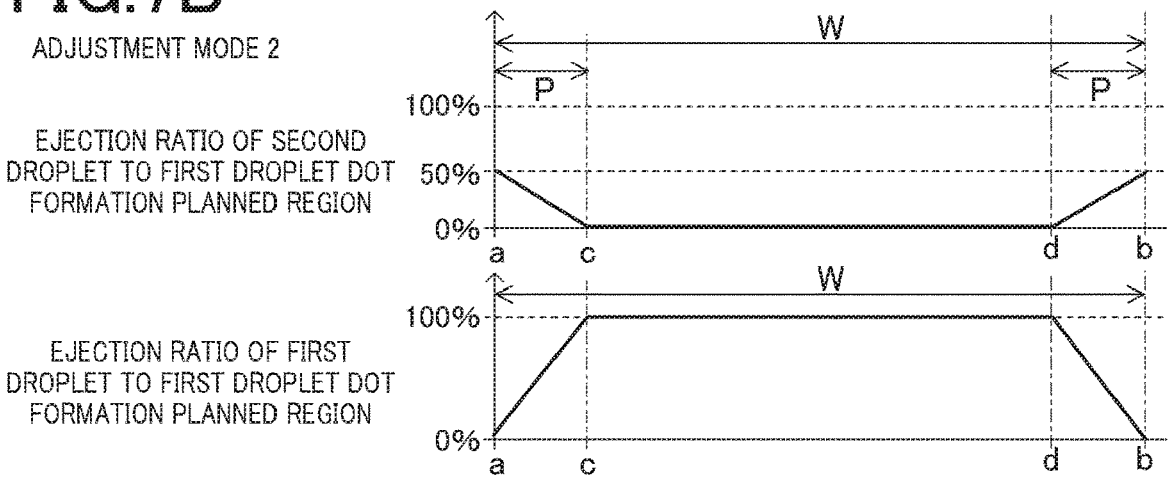
FIG. 7B is a diagram schematically showing an exemplary adjustment process of the ejection ratio.
Figure 7C:
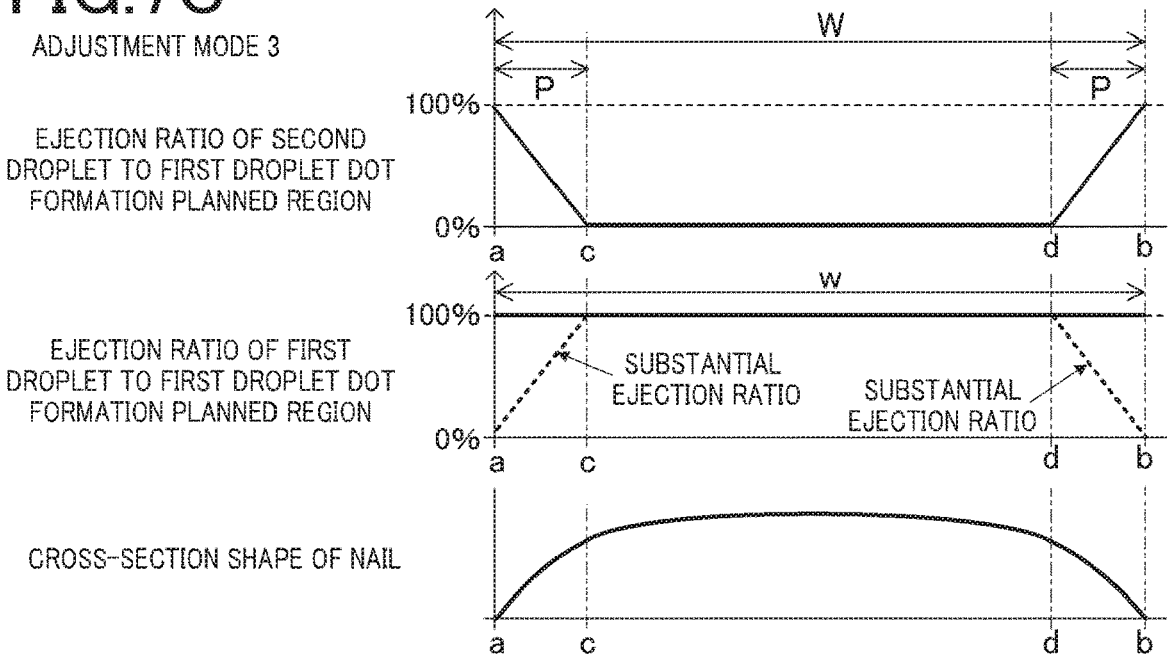
FIG. 7C is a diagram schematically showing an exemplary adjustment process of the ejection ratio.

In FIG. 7A to FIG. 7C, "W" means the nail width W in the same manner as in FIG. 5A and FIG. 5B, and "a" and "b" means both end portions in the width direction of the nail T. Also, "P" indicates the width of the adjustment region CA in the same manner as in FIG. 5B. That is, in FIG. 7A to FIG. 7C, the adjustment region CA is set in an end portion region toward the central portion from both end portions a and b in the width direction of the nail T, (between a-c and d-b in FIG. 7A to FIG. 7C) and in the region of the width P of the adjustment region CA.

In addition, FIG. 7A to FIG. 7C show the ejection ratio of the second droplet to the first droplet dot formation planned region on the upper side of the graph, and the ejection ratio of the first droplet to the first droplet dot formation planned region on the lower side of the graph.

As described above, at the end portion of the curved nail T, the distance between the nail T and the drawing head 41 (distance H2 in FIG. 5B) becomes larger than the distance H1 as shown in FIG. 5B, and landing properties decrease in the first droplet dot formed by the first droplet, thereby disturbing the drawn image and decreasing the density of the drawn image.

Therefore, in the present embodiment, the adjustment region CA for increasing the ejection ratio of the second droplet with respect to the first droplet dot formation planned region is set in the end portion region from both end portions a and b in the width W direction of the nail T toward the central portion, and in the adjustment region CA, the drawing controller 814 controls the ejection of the droplet by the ink from the drawing head 41 so as to increase the ejection ratio of the second droplet with respect to the first droplet formation planned region toward both end portions a and b of the nail T.

Various methods can be adopted as a method of adjusting the ejection ratio of the second droplet and the ejection ratio of the first droplet in the first droplet dot formation planned region in the adjustment region CA. Three types of adjustment modes of control performed by the drawing controller 814 are illustrated in FIG. 7A to FIG. 7C.

First, the central portion of the nail T which is not the adjustment region CA, (the region between c and d in 6A) is substantially flat.

For this reason, the drawing controller 814, in common with each adjustment mode (adjustment mode 1 to adjustment mode 3 shown in FIG. 7A from FIG. 7C), in the region between c and d in the width direction of the nail T, the second droplet is ejected at a position defined to form a second droplet dot in the drawing data created on the premise of drawing on a non-curved surface (plane) such as paper, and the first droplet is ejected at a position defined to form the first droplet dot. That is, in this region, the ejection ratio of the second droplet to the first droplet dot formation planned region is 0%, and the ejection ratio of the first droplet is 100%.

Then, in the adjustment mode 1 shown in FIG. 7A, in the adjustment region CA of the width P in the end portions a to c and in the end portions d to b in the nail width W direction, the drawing controller 814 decreases the ejection ratio of the first droplet from c toward the end portion a and from d toward the end portion b and increases the ejection ratio of the second droplet with respect to the first droplet dot so as to compensate for the above. That is, in the adjustment mode 1, in the adjustment region CA, control is performed so as to replace at least some of the plurality of first droplet dots defined in the drawing data with the second droplet dots, and the ratio replaced to the second droplet dots among the plurality of first droplet dots is increased from c toward the end portion a. Similarly, the ratio of replacing to the second droplet dot among the plurality of first droplet dots is increased from d toward the end portion b.

Then, the drawing controller 814 controls the ejection of droplets of the ink from the drawing head 41 so as to replace all of the plurality of first droplet dots with the second droplet dot, with the ejection ratio of the first droplet being 0% at any position toward both end portions a and b in the width W direction of the nail T in the adjustment region CA.

In the examples shown in FIG. 7A, the drawing controller 814 gradually decreases the ejection ratio of the first droplet in the adjustment region CA toward both end portions a and b in the width W direction of the nail T, increases the ejection ratio of the second droplet in the first droplet dot formation planned region CA, and replaces the first droplet dot with the second droplet dot in a one-to-one manner. In the case shown here, the ejection ratio of the first droplet is 0% at both end portions a and b in the width W direction of the nail T and the ejection ratio of the second droplet to the first droplet dot formation planned region is 100%, and all of the plurality of first droplet dots are replaced with the second droplet dots.

In this case, it is possible to suppress the first droplet from becoming mist-like and scattering in the device without landing. In addition, since the total amount of ink is larger in the latter of the first droplet dots and the second droplet dots having the same number, and the color is darker in the latter than in the former, it is also possible to suppress the problem that the color of the image drawn at the end portion of the nail T is lighter without separately performing the curved surface correction. However, when all of the plurality of first droplet dots are replaced with the second droplet dots, the total amount of ink in the adjustment region CA may become too large, and the color of the image drawn at the end portion of the nail T may become too dark.

Next, in the adjustment mode 2 shown in FIG. 7B, similar to the case of the adjustment mode 1 shown in FIG. 7A, in the adjustment region CA of the width P in the end portions a to c and the end portions d to b in the nail width W direction, the drawing controller 814 decreases the ejection ratio of the first droplet from c toward the end portion a and from d toward the end portion b, and increases the ejection ratio of the second droplet to the first droplet dot formation planned region so as to compensate for the above. The ejection ratio of the first droplet is set to 0% at both end portions a and b in the width W direction of the nail T, and the ejection ratio of the second droplet to the first droplet dot is set to be smaller than 100%. In the example shown in FIG. 7B, the ejection ratio of the second droplet to the first droplet dot formation planned region is 50% at both end portions a and b of the nail T in the width W direction.

That is, also in the adjustment mode 2, in the adjustment region CA, control is performed so as to replace at least some of the plurality of first droplet dots defined in the drawing data with the second droplet dots, and the ratio of the plurality of first droplet dots replaced with the second droplet dots is increased from c toward the end portion a. Similarly, the ratio of the plurality of first droplet dots replaced with the second droplet dot is increased from d toward the end portion b. However, in the adjustment mode 2, in the adjustment region CA, the first droplet dot is not replaced with the second droplet dot in a one-to-one manner, but the portions in the first droplet dot formation planned region where the first droplet dots are not formed in accordance with the ejection ratio of the first droplet are replaced with the second droplet dots in a ratio corresponding to the value of the ejection ratio of the second droplet to the first droplet dots. That is, as shown in FIG. 7B, when the ejection ratio of the first droplet is 0% at both end portions a and b and the ejection ratio of the second droplet to the first droplet dot formation planned region is 50%, 50% among the plurality of first droplet dots defined in the drawing data is replaced with the second droplet dots. Further, for example, when the ejection ratio of the first droplet is 50% and the ejection ratio of the second droplet with respect to the first droplet dot formation planned region is 25%, the first droplet dot is formed in 50% of the plurality of first droplet dots defined in the drawing data, and 25% of the plurality of first droplet dots is replaced with the second droplet dot.

In the adjustment mode 2, it is possible to suppress the density of the image drawn at the end portion of the nail T from becoming too high.

Then, in the adjustment mode 3 shown in FIG. 7C, as in the case of the adjustment mode 1 shown in FIG. 7A, in the adjustment region CA with the width P in the end portion a to c and the end portion d to b in the nail width W direction, the drawing controller 814 increases the ejection ratio of the second droplet to the first droplet dot formation planned region from c toward the end portion a and from d toward the end portion b. However, in the adjustment mode 3, the ejection ratio of the first droplet is not reduced in the adjustment region CA, and the ejection ratio of the first droplet is maintained at 100% in the adjustment region CA as in the region between c and d. That is, in the adjustment mode 3, in the adjustment region CA, the first droplet is ejected to the position of the plurality of first droplet dots defined in the drawing data, and the second droplet is ejected to the position which is the same as at least some of the plurality of first droplet dots to form the second droplet dots. In this case, as described above, the landing rate of the first droplet decreases as the first droplet approaches the end in the direction of the nail width W in the adjustment region CA. Therefore, as shown by the dotted line in the graph of the ejection ratio of the first droplet in FIG. 7C, the substantial ejection ratio of the first droplet decreases nearer to the end portion in the nail width W direction. Therefore, as a result, as in the case of the above-described adjustment mode 1, the state is similar to when the ejection ratio of the first droplet is gradually decreased toward the end portion in the nail width W direction. Therefore, substantially the same result as in the case of the adjustment mode 1 can be obtained.

The method of adjusting the ejection ratio of the second droplet and the ejection ratio of the first droplet with respect to the first droplet dot formation planned region in the adjustment region CA is not limited to the adjustment mode 1 to the adjustment mode 3, but can be appropriately set.

For example, the ejection ratio of the second droplet to the first droplet dot formation planned region may be increased so as to compensate for the decrease in the first droplet landing from the change in the landing amount of the first droplet corresponding to the change in the distance between the drawing head 41 and the nail surface due to the shape of the nail T.

In addition, the rate at which the landing amount of the first droplet decreases in accordance with a change in the distance between the drawing head 41 and the nail surface is obtained from an experiment, and if, for example, the reduction rate of the landing amount of the first droplet is about 50%, (that is, about 50% of the first droplet lands), the second droplet may be gradually increased to 50% of the ejection amount of the first droplet.

In addition, the curve for increasing the second droplet does not have to be adapted to a linear shape or a nail shape. For example, a curve formed in accordance with the landing properties of the first droplet may be used.

The correction curve which uses the second droplet to compensate for the decrease in the landing amount of the first droplet changes in accordance with the ejection amount of the second droplet in one ejection and the ejection amount of the first droplet in one ejection.

The ejection ratio of the first droplet is not limited to 0% at the end portions a and b of the nail T as shown in FIG. 7A and FIG. 7B, and may be 0% at any point toward the end portions a and b of the nail T.

The display controller 815 controls the display device 13 to display various display screens.

In the present embodiment, the display controller 815 displays, for example, a nail image obtained by imaging the finger U1, a design selection screen for selecting an image to be drawn on the nail T (i.e., "nail design"), a thumbnail image for design confirmation, an instruction screen for displaying various instructions, and the like on the display device 13.

When setting the adjustment region CA, the display device 13 may be configured to display in which range of the nail T the adjustment region CA is set. As a result, the user can confirm the setting range of the adjustment region CA and change/correct the setting range as necessary.

Figure 8:
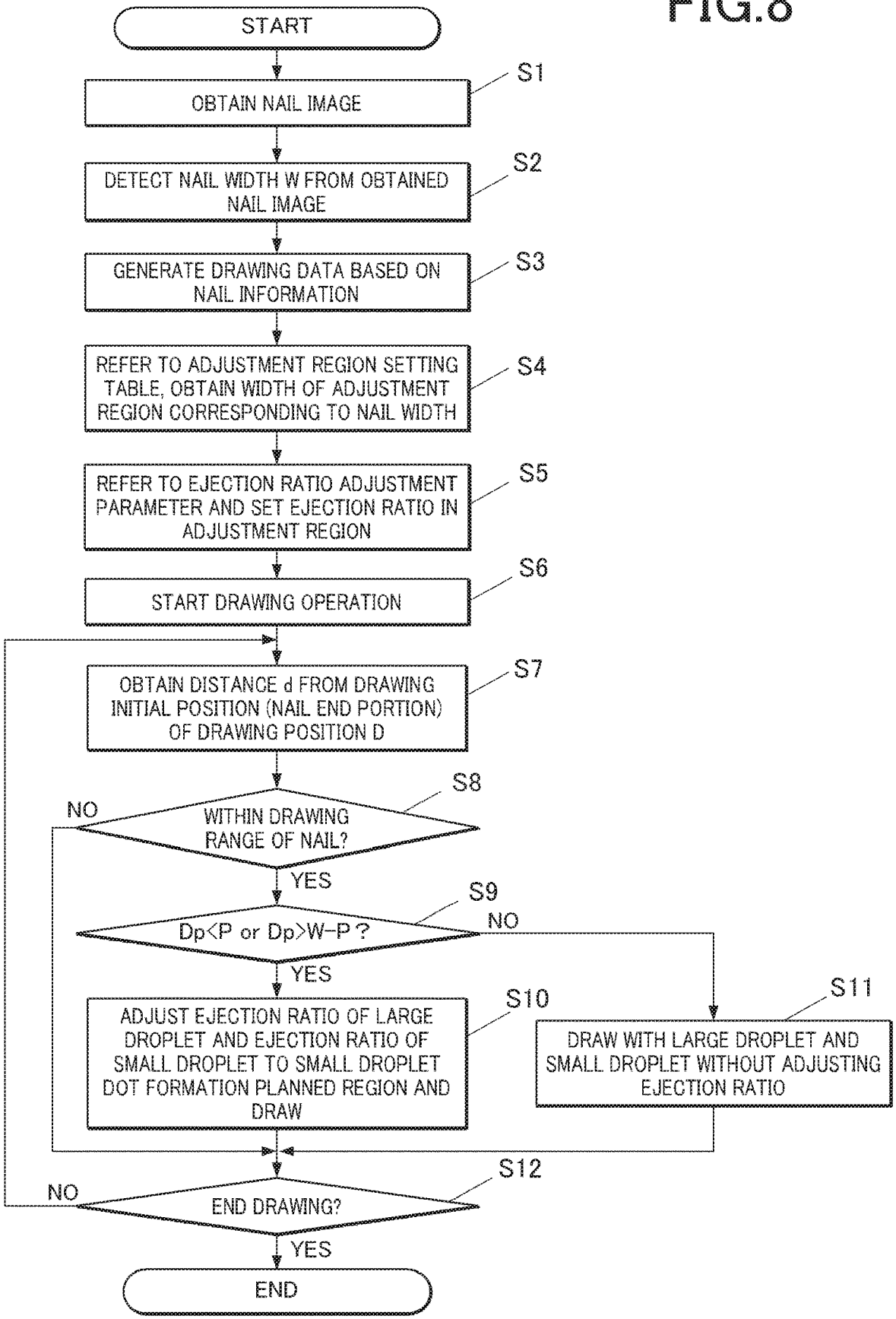
FIG. 8 is a flowchart showing the drawing process in the present embodiment.

Next, a drawing method by the nail printing device 1 according to the present embodiment will be described with reference to FIG. 8 and the like.

When drawing is performed by the nail printing device 1, the user first turns on the power switch to start the control device 80.

The display controller 815 causes the display device 13 to display a design selection screen, and the user operates the operation unit 12 or the like to select a desired nail design from among a plurality of nail designs displayed on the design selection screen, so that a selection instruction signal is output from the operation unit 12, and one nail design is selected.

Next, the user inserts the finger U1 into the finger fixing portion 3. When the positioning of the finger U1 is completed, the imaging controller 811 controls the imaging mechanism 50 to image the nail T of finger U1, and as shown in FIG. 8, acquires the nail image (step S1). When the nail image is acquired, the nail information detector 812 detects the nail width W in addition to the nail shape (contour of the nail T) and the curvature of the nail T from the nail image (step S2). When the nail information is acquired, the drawing data generator 813 matches the nail design image data with the nail T, makes corrections, and generates drawing data (step S3). The generated drawing data is sent to the drawing controller 814.

Further, when the nail width W is detected, the drawing controller 814 reads the adjustment region setting table 822 from the ejection control data storage region 821, refers to this, and obtains the width P of the adjustment region CA corresponding to the nail width W (see FIG. 5B and FIG. 6A) (step S4). In the adjustment region setting table 822, when the width P of the adjustment region CA is defined by the ratio to the nail width W (for example, 10% of the nail width W, etc.), the width P of the adjustment region CA in the nail width W is calculated using the ratio acquired with reference to the adjustment region setting table 822. For example, when the ratio of the width P of the adjustment region CA to the nail width W is 10%, P=W×10/100, and when the nail width W is 20 mm, the width P of the adjustment region CA is 2 mm.

Next, the drawing controller 814 sets the ejection ratio of the second droplet to the first droplet dot and the ejection ratio of the first droplet in the adjustment region CA with reference to the ejection ratio adjustment parameter (step S5). That is, any one of the adjustment modes 1 to 3 shown in FIG. 7A to FIG. 7C is set so as to be applied in the drawing operation.

When the width P of the adjustment region CA and the adjustment mode are set, the drawing controller 814 outputs drawing data to the drawing mechanism 40 and starts a drawing operation (step S6).

At this time, the drawing operation is performed while moving the drawing head 41 from one end portion of the width direction of the nail T (drawing initial position) toward the other end portion, and the drawing controller 814 acquires the distance Dp (Dp1, Dp2) from the drawing initial position (nail end portion) of the drawing position (two drawing positions D1 and D2 are exemplified by black dots in FIG. 5B) as necessary (step S7). Then, the drawing controller 814 determines whether or not the drawing position is within the drawing range of the nail T (that is, inside the contour of the nail T) from the acquired distance Dp (step S8). If it is determined that the drawing position is within the drawing range (step S8; YES), the drawing controller 814 determines whether or not the drawing position is within the adjustment region CA in which it is necessary to adjust the ejection ratio of the first droplet and the second droplet (step S9). Specifically, when Dp<P or Dp>W−P, the drawing position is determined to be within the adjustment region CA (step S9; YES) and otherwise, the drawing position is determined to be not within the adjustment region CA (Step S9; NO), that is, it is determined that the ejection ratio of the first droplet is 100% and the ejection ratio of the second droplet to the first droplet dot is 0% in the region.

That is, for example, when the nail width W is 20 mm, and the width P of the adjustment region CA is 2 mm, the drawing position D1 in which the distance Dp (Dp1) from the drawing initial position (nail end portion) in FIG. 5B is Dp1<P (for example, 1.8 mm) is determined to be in the adjustment region CA. Further, the drawing position D2 in which the distance Dp (Dp2) from the drawing initial position (nail end portion) in FIG. 5B is Dp2>P (e.g., 5 mm) is determined to be outside the adjustment region CA.

When it is determined that the drawing position is within the adjustment region CA (step S9; YES), the drawing controller 814 controls the drawing head 41 to draw by, for example, decreasing the ejection ratio of the first droplet and increasing the ejection ratio of the second droplet with respect to the first droplet dot (step S10). When it is determined that the drawing position is not within the adjustment region CA (that is, determined to be outside the adjustment region CA) (step S9; NO), the drawing controller 814 controls the drawing head 41 to draw by the first droplet and the second droplet by setting the ejection ratio of the first droplet to 100% and setting the ejection ratio of the second droplet to the first droplet dot formation planned region to 0% (step S11).

When drawing is performed by ejecting the first droplet and the second droplet at a predetermined ejection ratio (step S10 or step S11), or when the drawing position is not within the drawing range of the nail T (step S8; NO), the drawing controller 814 determines whether drawing of the nail T has been completed (step S12). When it is determined that drawing has not been completed (step S12; NO), the process returns to step S7 to repeat the process. On the other hand, when it is determined that the drawing of the nail T has been completed (step S12; YES), the drawing controller 814 ends the drawing process.

When there is another finger nail T to be drawn, the finger U1 is replaced, and the above processing is repeated.

When the user desires to change the width P of the adjustment region CA by looking at the nail T on which the drawing is completed, the parameter can be changed and adjusted by operating the operation unit 12. That is, for example, when there is an impression that a region in which an image is drawn with high density in the vicinity of the end portion of the nail T is too wide, the parameter is corrected in the direction in which the width P of the adjustment region CA is narrowed (the region in which the second droplet is increased is narrowed), and when it is felt that a droplet due to ink is not sufficiently adhered to the vicinity of the end portion of the nail T or there is a portion in which the color is light, the parameter is corrected in the direction in which the width P of the adjustment region CA is widened (the region in which the second droplet is increased is widened). The modified parameters are stored in the ejection control data storage region 821 in the modified state. It is preferable that the parameter after the correction is referred to in the next and subsequent drawing in which the nail T of the same finger of the same user is the drawing target.

As described above, according to the present embodiment, in the case where the nail printing device 1 performs drawing by the drawing head 41 configured to be capable of selectively ejecting the first droplet and the second droplet having a larger droplet volume than the first droplet, the nail printing device 1 detects the length in the width direction of the nail T which is the drawing target as the nail width W, sets the adjustment region CA, in which the ejection ratio of the second droplet to the first droplet dot formation planned region is increased, in the end portion region from both end portions a and b in the width direction of the nail T toward the central portion, and controls the ejection of the droplet by the ink from the drawing head 41 so as to increase the ejection ratio of the second droplet to the first droplet formation planned region in the adjustment region CA.

As a result, even at the end portion of the nail T where accurate landing is difficult with the first droplet, disturbance of the drawn image or decrease in the density of the drawn image can be suppressed, and a nail print with a beautiful finish can be applied to the entire nail T.

Further, in the present embodiment, the nail width W when the nail T is viewed from above is simply detected from the image acquired by the imaging mechanism 50, the adjustment region CA is defined at the end portion of the nail T based on the nail width W and a table or parameter stored in advance, and the ejection ratio of the second droplet is increased in the adjustment region CA, thereby suppressing the decrease in the density of the image drawn at the nail end portion. Therefore, it is not necessary to measure the distance from the drawing head 41 to the surface of the nail T, and it is not necessary to provide a sensor or the like separately. With this, it is possible to realize a high-definition drawing employing a simple and inexpensive device configuration.

In the present embodiment, the drawing controller 814 controls the ejection of the ink droplets from the drawing head 41 so as to gradually increase the ejection ratio of the second droplet to the first droplet dot formation planned region in the adjustment region CA.

By doing so, streaks, color unevenness, and the like are less likely to occur at the inner and outer boundary portions of the adjustment region CA, and a more natural and high-definition finish can be realized.

In addition, in the present embodiment, the drawing controller 814 controls the ejection of the droplet by the ink from the drawing head 41 so as to reduce the ejection ratio of the first droplet and to eject the second droplet in an amount that compensates for the decrease in the adjustment region CA.

As a result, even when the first droplet dot is replaced with the second droplet dot in the adjustment region CA, the ink density does not become too high, and a natural finish can be obtained.

Further, in the present embodiment, the drawing controller 814 controls the ejection of droplets by ink from the drawing head 41 so that the ejection ratio of the first droplet is 0% at any position toward both end portions a and b in the width W direction of the nail T in the adjustment region CA.

Since the distance between the drawing head 41 and the surface of the nail T is apart in the adjustment region CA which is an end portion of the nail T, the landing rate of the first droplet decreases. For this reason, even if the first droplet is ejected, the droplet lands at an offset position, which may disturb the finish of the drawing, or may become a mist-like ink droplet which scatters in the air and adheres to the inside of the device.

In this respect, by setting the ejection ratio of the first droplet to 0% at any position within the adjustment region CA, it is possible to suppress the problems caused by the first droplet that could not be correctly landed.

Further, in the present embodiment, on the basis of the detection result by the nail information detector 812, an ejection ratio adjusting parameter 823 that defines the ejection ratio of the second droplet to the first droplet formation planned region in the adjustment region CA and the ejection ratio of the first droplet are stored in the ejection control data storage region 821 of the storage 82, and the drawing controller 814 controls the ejection of the droplet by the ink from the drawing head 41 in the adjustment region CA with reference to the ejection ratio adjusting parameter 823.

As a result, the ejection ratio can be easily controlled based on the parameters.

Although the embodiments of the present invention have been described above, the present invention is not limited to such embodiments, and it is needless to say that various modifications are possible without departing from the scope thereof.

For example, in the target embodiment, the parameter corresponding to the curved level of the nail T in FIG. 6B is exemplified in the case where the drawing controller automatically selects the level to be applied from among the prepared curved levels, but the sorting and selection of the curved level of the nail T is not limited to the case where the processor 51 automatically performs the sorting and selection, and for example, the user or the staff of the nail salon may select a pattern that appears to be suitable for the nail T to be drawn, and may instruct input on the operation unit 12 or the like to use the parameter corresponding to the pattern.

Thus, the nail T is classified by pattern, and by applying different parameters for each pattern, it is possible to set the width of the more appropriate adjustment region CA according to the shape of each nail T.

In the present embodiment, the case where the program storage region 820, the ejection control data storage region 821, the nail design storage region 824, the nail image storage region 825, the nail information storage region 826, and the like are provided in the storage 82 of the control device 80 is exemplified, but these storage regions are not limited to the case where they are provided in the storage 82 (ROM, RAM) of the control device 80, and a separate storage may be provided.

The nail printing device 1 may be linked with an external terminal device to use information stored in the external terminal device.

In the present embodiment, the nail printing device 1 is used as an example in which fingers are inserted one by one into the device and drawing is performed sequentially, but the present invention can also be applied to a device in which a plurality of fingers are inserted at the same time and drawing can be performed successively on each finger.

Although several embodiments of the present invention have been described above, the scope of the present invention is not limited to the embodiments described above, and the scope of the invention includes the scope described in the claims and the equivalent scope thereof.

INDUSTRIAL APPLICABILITY

The present invention can be applied to a drawing device or a drawing method for drawing a nail design on a nail.

REFERENCE SIGNS LIST

1 Nail printing device
40 Drawing mechanism
50 Imaging mechanism
41 Drawing head
81 Processor
811 Imaging controller
812 Nail information detector
814 Drawing controller
821 Ejection control data storage region
822 Adjustment region setting table
823 Ejection ratio adjustment parameter
T Nail
U1 fingers

The invention claimed is:

1. A drawing device comprising:

a drawing head; and a processor which controls the drawing head, wherein:

the drawing head draws an image by selectively forming a first droplet dot formed by a first droplet and a second droplet dot formed by a second droplet including a larger droplet amount than the first droplet on a drawing target surface curved convexly along a first direction, the processor controls ejection by the drawing head so as to form the first droplet dot in a first droplet dot formation planned region in which the first droplet dot is to be formed based on drawing data of the image, and to form the second droplet dot in a second droplet dot formation planned region in which the second droplet dot is to be formed based on the drawing data, the drawing data is image data for drawing the image on a non-curved surface, the processor controls the ejection by the drawing head to as to form the second droplet dot in at least a part of an adjustment region in at least one end of ends in the first direction of the drawing target surface, the first droplet dot formation region overlaps with the adjustment region, and the processor controls the ejection by the drawing head so that a ratio of forming the second droplet dot in the first droplet dot formation planned region in the adjustment region increases toward the end of the drawing target surface in the first direction.

2. The drawing device according to claim 1, wherein the processor controls the ejection by the drawing head so that a ratio of forming the first droplet dot with respect to the first droplet dot formation planned region in the adjustment region decreases toward the end of the drawing target surface in the first direction.

3. The drawing device according to claim 2, wherein the processor controls the ejection by the drawing head so that the ratio of forming the first droplet dot with respect to the first droplet dot formation planned region in the adjustment region is 0% at any position toward the end along the first direction in the adjustment region.

4. The drawing device according to claim 2, wherein the processor controls the ejection by the drawing head so as to form the second droplet dot in at least a part of a region in which the first droplet dot is not to be formed in the first droplet dot formation planned region in the adjustment region.

5. The drawing device according to claim 2, wherein the processor controls ejection by the drawing head so as to form the second droplet dot in a region in which the first droplet dot is not to be formed in the first droplet dot formation planned region in the adjustment region.

6. The drawing device according to claim 1, wherein:

the drawing target surface is a surface of a nail of a finger or a surface of ink applied to the nail, the first direction is a width direction of the nail, the processor detects a width of the drawing target surface and a curvature in the width direction, and the processor sets the adjustment region based on the width of the drawing target surface and the curvature in the width direction.

7. The drawing device according to claim 1, wherein:

the drawing target surface is a surface is a surface of a nail of one of a plurality of fingers of a hand or a surface of a region of the nail in which ink is applied, the first direction is a width direction of the nail, and the processor detects a type of the finger having the drawing target surface among the plurality of fingers, and sets the adjustment region based on the detected type of the finger.

8. A drawing method for a drawing device including a drawing head and a processor which controls the drawing head, the method comprising:

drawing an image by selectively forming a first droplet dot formed by a first droplet and a second droplet dot formed by a second droplet including a larger droplet amount than the first droplet on a drawing target surface curved convexly along a first direction; and controlling ejection by the drawing head so as to form the first droplet dot in a first droplet dot formation planned region in which the first droplet dot is to be formed based on drawing data which is image data of the image to be drawn on a non-curved surface, and to form the second droplet dot in a second droplet dot formation planned region in which the second droplet dot is to be formed based on the drawing data, wherein the controlling comprises:

controlling the ejection by the drawing head to as to form the second droplet dot in at least a part of an adjustment region in at least one end of ends in the first direction of the drawing target surface, the first droplet dot formation region overlapping with the adjustment region, and controlling the ejection by the drawing head so that a ratio of forming the second droplet dot in the first droplet dot formation planned region in the adjustment region increases toward the end of the drawing target surface in the first direction.

9. The method according to claim 8, wherein the controlling comprises controlling the ejection by the drawing head so that a ratio of forming the first droplet dot with respect to the first droplet dot formation planned region in the adjustment region decreases toward the end of the drawing target surface in the first direction.

10. The method according to claim 9, wherein the controlling comprises controlling the ejection by the drawing head so that the ratio of forming the first droplet dot with respect to the first droplet dot formation planned region in the adjustment region is 0% at any position toward the end along the first direction in the adjustment region.

11. The method according to claim 9, wherein the controlling comprises controlling the ejection by the drawing head so as to form the second droplet dot in at least a part of a region in which the first droplet dot is not to be formed in the first droplet dot formation planned region in the adjustment region.

12. The method according to claim 9, wherein the controlling comprises controlling ejection by the drawing head so as to form the second droplet dot in a region in which the first droplet dot is not to be formed in the first droplet dot formation planned region in the adjustment region.

13. The method according to claim 8, wherein:

the drawing target surface is a surface of a nail of a finger or a surface of ink applied to the nail, the first direction is a width direction of the nail, and the controlling comprises detecting a width of the drawing target surface and a curvature in the width direction, and setting the adjustment region based on the width of the drawing target surface and the curvature in the width direction.

14. The method according to claim 8, wherein:

the drawing target surface is a surface is a surface of a nail of one of a plurality of fingers of a hand or a surface of a region of the nail in which ink is applied, the first direction is a width direction of the nail, and the controlling comprises detecting a type of the finger having the drawing target surface among the plurality of fingers, and setting the adjustment region based on the detected type of the finger.

15. The drawing device according to claim 1, wherein:

the processor generates the drawing data based on the drawing target surface and a specified design, and the drawing data comprises drawing position data of the first droplet dot and the second droplet dot on the drawing target surface.

* * * * *